US005625965A

United States Patent [19]

Blissett et al.

[11] Patent Number: 5,625,965

[45] Date of Patent: May 6, 1997

[54] STAND EASY SHOE INSERT

[75] Inventors: Malcolm G. Blissett, Grand Haven; Blanca A. Mercado, Grand Rapids, both of Mich.

[73] Assignee: Wolverine World Wide, Inc., Rockford, Mich.

[21] Appl. No.: 490,194

[22] Filed: Jun. 14, 1995

Related U.S. Application Data

[63] Continuation-in-part of Ser. No. 143,915, Oct. 27, 1993, Pat. No. 5,448,839.

[51] Int. Cl.[6] ..... A43B 13/38; A61F 5/14

[52] U.S. Cl. ..... 36/43; 36/44; 36/142; 36/143; 36/144

[58] Field of Search ..... 36/3 R, 3 B, 43, 36/44, 140, 142, 143, 144

[56] References Cited

U.S. PATENT DOCUMENTS

| | | | |
|---|---|---|---|
| D. 30,641 | 4/1899 | Peters . | |
| D. 267,366 | 12/1982 | Davis | D2/320 |
| 532,429 | 1/1895 | Rogers | 36/43 |
| 568,068 | 9/1896 | Hilgert | 36/3 R |
| 628,836 | 7/1899 | McMahon | 36/3 R |
| 1,741,419 | 12/1929 | Jones | 36/43 |
| 1,958,097 | 5/1934 | Shaw | 36/144 |
| 2,134,209 | 10/1938 | Schwenker | 36/144 |
| 2,160,991 | 6/1939 | Schwartz | 36/8.5 |
| 2,616,190 | 11/1952 | Darby | 36/71 |
| 3,169,326 | 2/1965 | Butera | 36/2.5 |
| 3,266,178 | 8/1966 | Gilkerson | 36/43 |
| 3,267,592 | 8/1966 | Champion | 36/35 |
| 3,550,597 | 12/1970 | Coplans | 36/144 |
| 3,566,486 | 3/1971 | Conway | 36/2.5 |
| 3,608,215 | 9/1971 | Fukuoka | 36/29 |
| 3,990,159 | 11/1976 | Borgeas | 36/101 |
| 4,003,146 | 1/1977 | Meier | 36/44 |
| 4,020,570 | 5/1977 | Shames | 36/44 |
| 4,041,618 | 8/1977 | Famolare | 36/25 |
| 4,041,619 | 8/1977 | Sapper | 36/25 |
| 4,133,118 | 1/1979 | Khalsa | 36/83 |
| 4,240,214 | 12/1980 | Sigle et al. | 36/43 |
| 4,557,059 | 12/1985 | Misevich | 36/32 |
| 4,578,882 | 4/1986 | Talarico, II | 36/103 |
| 4,620,376 | 11/1986 | Talarico, II | 36/103 |
| 4,624,062 | 11/1986 | Autry | 36/114 |
| 4,642,911 | 2/1987 | Talarico, II | 36/30 |
| 4,682,425 | 7/1987 | Simmons | 36/44 |
| 4,685,227 | 8/1987 | Simmons | 36/127 |
| 5,010,661 | 4/1991 | Chu | 36/43 |
| 5,216,824 | 6/1993 | Blissett | 36/28 |
| 5,448,839 | 9/1995 | Blissett et al. | 36/144 |
| 5,509,218 | 4/1996 | Arcan et al. | 36/43 |

FOREIGN PATENT DOCUMENTS

| | | |
|---|---|---|
| 1511344 | 2/1967 | France . |

*Primary Examiner*—M. D. Patterson

*Attorney, Agent, or Firm*—Price, Heneveld, Cooper, DeWitt and Litton

[57] ABSTRACT

A shoe and shoe sole insert having a heel portion slanted downwardly at a small acute angle from the medial side to the lateral side relative to the horizontal support surface, a forefoot portion slanted downwardly at a small acute angle from the lateral side to the medial side relative to the horizontal support surface, and a diagonally crossing ridge from the heel portion, across the midfoot portion to the forefoot portion. The heel portion has a central, resilient, compressible, calcaneal pad which is substantially unslanted, preferably with an air cavity therebeneath. The calcaneal pad protrudes upwardly above the upper surface of the heel portion. The metatarsal head pad extends upwardly above the upper surface of the forefoot portion. The pivot point or crossover point between the heel portion and the forefoot portion is preferably located a distance from the rear end of the insert equal to the insert length divided by 2.4. Air cavities are beneath the calcaneal and metatarsal pads, with orifices from these cavities to the pad upper surfaces. Air flow channels extend between these air cavities. The ridge is tangential to the medial side of the calcaneal pad and tangential to the lateral side of the metatarsal pad. The shoe is preferably a flat-bottom-last formed shoe.

20 Claims, 4 Drawing Sheets

Fig. 11a
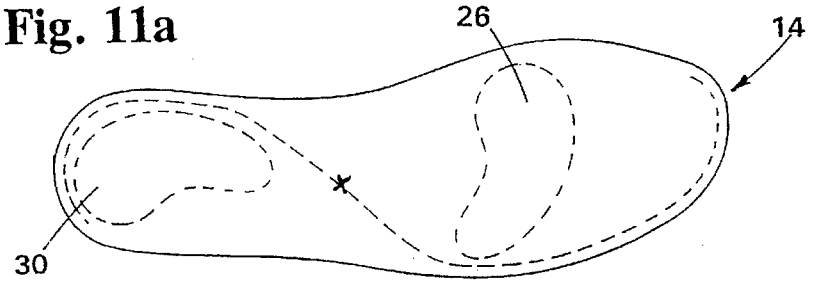
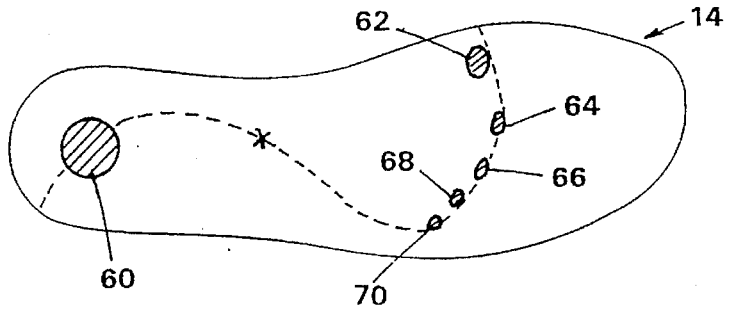
Fig. 11b
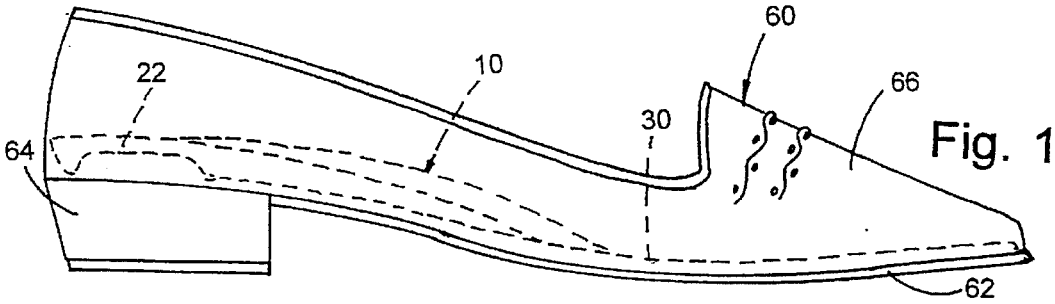
Fig. 17
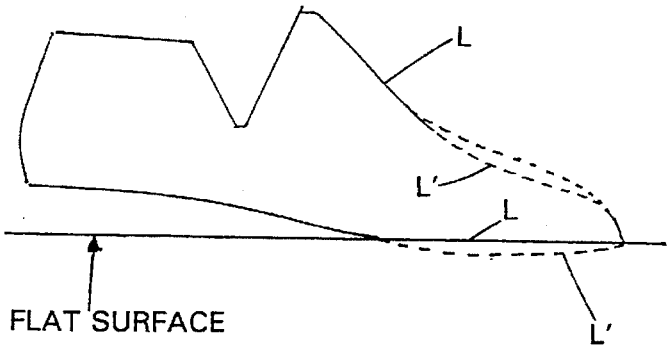
Fig. 15
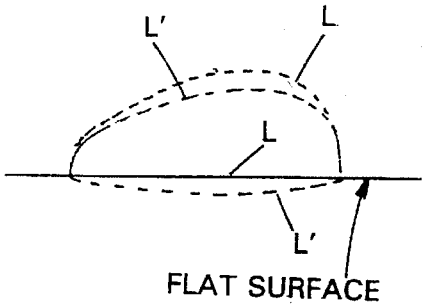
Fig. 16

STAND EASY SHOE INSERT

RELATED APPLICATION

This is a continuation-in-part application of application Ser. No. 08/143,915, filed Oct. 27, 1993, now U.S. Pat. No. 5,448,839 and entitled STAND EASY SHOE.

BACKGROUND OF THE INVENTION

This invention relates to shoes and shoe sole inserts, and particularly to inserts for shoes of persons who experience prolonged periods of standing.

In recent decades, tremendous efforts and cost have been put forth for research into the complex action of the human foot during various types of activity, and into the engineering and design of footwear to maximize benefits to the wearer during these activities. Specifically, extensive research has been conducted for activities including basketball, aerobics, running, jogging and football, as well as desired characteristics of footwear for these activities. Even the activity of walking and the design of walking shoes has been explored relative to the complex foot action involved, but to a lesser extent. Moreover, substantial efforts have been made relative to the function and design of work boots relative to foot action.

One area of human activity which is not believed to have received the attention it deserves is that of prolonged standing. The nature and function of the complex human foot, and the effects on the leg and body during standing, are complicated. As is known by anyone who has had an occupation or activity involving long periods of standing, e.g., store clerks, factory workers, cashiers, theater personnel, or even persons who have had to wait in long lines such as at amusement parks, theaters, etc., standing can cause particular foot and leg fatigue and stress, even stress to the spinal area.

The foot is comprised of about 25 percent of all of the bones in the human body. The foot functions to support the weight of the body and to absorb shock and propel it forward during human movement. During standing, the arch of the foot functions much like the truss of a suspension bridge, the muscle/tendon junctions of the lower leg functioning to support the arch of the foot.

The strongest structure of the foot while standing is a high arched or neutral position. In this position, proper biomechanical posture and balance are maintained. When the arch of the foot collapses, greater stress is applied to the muscle/tendon junctions causing fatigue or even injury. Comfort while standing is correlated to balance and posture of the human body. When the muscles of the lower leg and foot begin to fatigue after extended periods of standing, people tend to become restless. They continually shift their body weight from leg to leg and flex their knees to alleviate concentrated stress to muscles and tendons.

SUMMARY OF THE INVENTION

An object of this invention is to provide a special shoe sole insert and shoe and insert combination having superior comfort during standing, particularly standing for extended periods of time.

The novel flexible, elongated shoe sole insert has a heel portion with an upper surface slanted downwardly at a small acute angle from the medial side to the lateral side and a central, resilient, compressible, calcaneal pad which is substantially unslanted. The calcaneal pad has an air cavity beneath it, and orifices from the cavity up to the pad upper surface. A compressible, elevated, diagonal ridge extends from the medial side of the heel portion to the lateral side of the forefoot portion. The insert has a forefoot portion with an upper surface slanted downwardly at a small acute angle from the lateral side to the medial side, i.e., opposite to that of the heel portion, and a central, elongated, resilient, compressible metatarsal pad which is substantially unslanted. The shoe sole insert effects a yams wedge of about 3°–5° to the horizontal at the heel portion and a valgus wedge of about 3°–5° to the horizontal at the forefoot portion. The metatarsal head pad has an air cavity beneath it, and orifices extending up from this air cavity to the pad upper surface. There are passageways in the insert connecting the calcaneal pad and metatarsal pad cavities.

The shoe used in combination with this insert is preferably made from a flat bottom last, i.e., is flat-bottom located, for even greater comfort.

These and other objects, advantages and features of the invention will be apparent from a review of the following specification in conjunction with the drawings.

BRIEF DESCRIPTION OF THE DRAWINGS

FIG. 11*a* is a simplified bottom plan view of a shoe employing this invention;

FIG. 11*b* is a bottom plan view of the shoe showing the main contact points of a foot when standing;

FIG. 15 is a diagrammatic side elevational view of a shoe last preferably used with this invention;

FIG. 16 is a diagrammatic front elevational view of the front of the shoe last in FIG. 15; and FIG. 17 is a side elevational view of the lateral side of a shoe and insert combination.

DESCRIPTION OF THE PREFERRED EMBODIMENT

Figure 1:
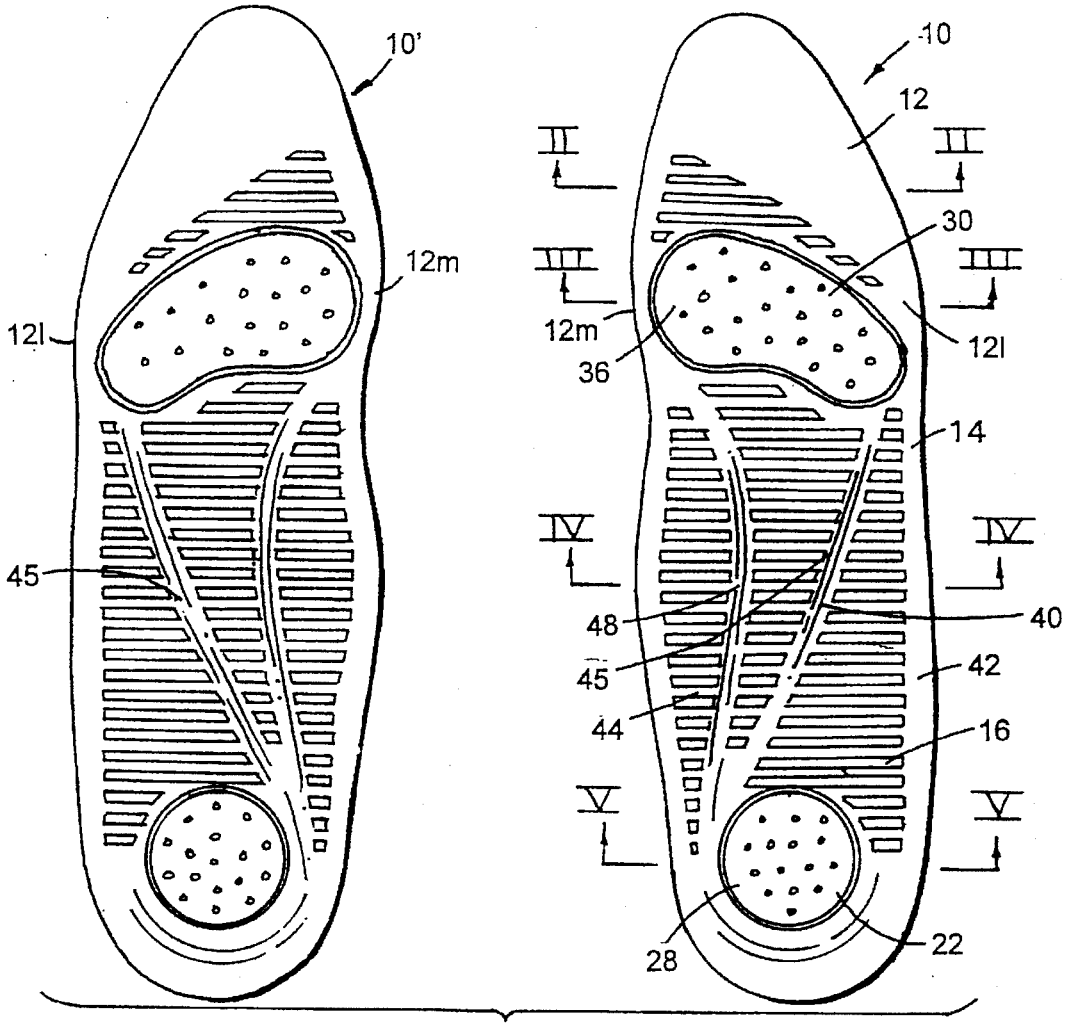
FIG. 1 is a top view of a pair of the novel shoe sole inserts.
Figure 2:
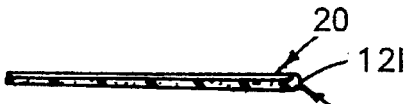
FIG. 2 is a sectional view taken on plane II—II of FIG. 1, i.e., of the right foot insert.
Figure 4:
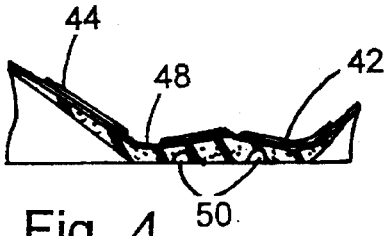
FIG. 4 is a sectional view taken on plane IV—IV of the right foot insert of FIG. 1.

Referring now specifically to the drawings, FIGS. 1 shows a pair of fight and left inserts 10 and 10' to be inserted inside a pair of shoes. These inserts are the mirror image of each other. Therefore, only the right insert will be described in detail relative to the other figures. This insert comprises a flexible, elongated shoe sole insert having a forefoot portion 12, a midfoot portion 14 and a heel portion 16. The entire insert is of unitary construction, preferably being formed of an underlayer 18 (FIG. 2) of polymeric foam-type material, e.g., polyurethane microcellular foam, bonded to an upper layer 20 of cloth, e.g., nylon or the like, to form a unitary structure. The foam and upper layer are of a type capable of being thermoformed into a desired final configuration by the use of heat and pressure of heated forming dies.

Figure 5:
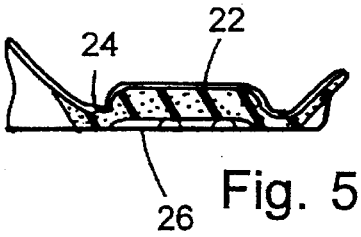
FIG. 5 is a sectional view taken on plane V—V of the fight foot insert of FIG. 1.
Figure 10:
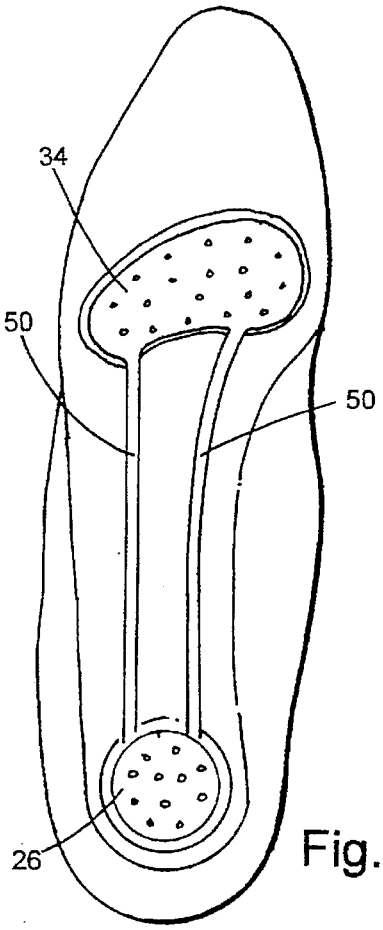
FIG. 10 is a bottom plan view of the fight shoe sole insert.
Figure 6:
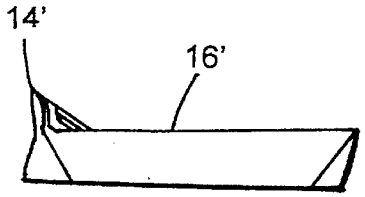
FIG. 6 is a rear elevational view of the fight shoe sole insert.
Figure 7:
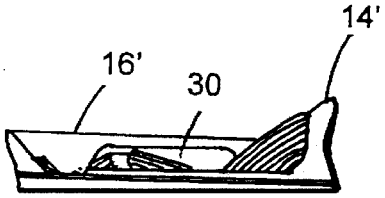
FIG. 7 is a front elevational view of the fight shoe sole insert.

Centrally of heel portion 16 is a calcaneal pad 22 shown to be generally circular in configuration and thermoformed to preferably be vertically offset upwardly relative to the adjacent upper surface of the insert portion (FIG. 5) that extends around a narrow, annular, peripheral depression 24 which surrounds pad 22. Beneath calcaneal pad 22 is an air cavity 26. A plurality of vertical orifices 28 extend from air cavity 26 up to the upper surface of calcaneal pad 22.

Figure 3:
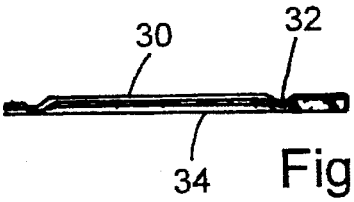
FIG. 3 is a sectional view taken on plane III—III of the right foot insert of FIG. 1.

Generally centrally of the forefoot portion 12, in the metatarsal head area, is a metatarsal pad 30 elongated and kidney-shaped in configuration to extend beneath all five metatarsal heads of a foot resting on the insert. This pad is also preferably vertically offset upwardly (FIG. 3) by thermoforming, to extend above the surrounding portion of the insert, and being defined and separated from the surrounding upper surface portion of the insert by peripheral depression 32 formed into the insert. Beneath pad 30 is an air cavity 34. A plurality of orifices 36 extend vertically from this air cavity 34 up to the upper surface of metatarsal pad 30.

Extending from the lateral side of metatarsal pad 30, generally tangential thereto, diagonally across the midfoot portion of the insert to the medial side of calcaneal pad 22, is a vertically elevated ridge 40 of thicker, i.e., greater, height polymer 18. Ridge 40 extends diagonally to be tangential to the medial side of the calcaneal pad. The pad tapers down on both sides of ridge 40 by having the thickness of polymeric layer 18 taper down, such that the rear foot bearing surface on the lateral side of this ridge slopes downwardly outwardly toward the lateral edge of the insole and the forward foot bearing surface on the medial side of the ridge slopes downwardly inwardly toward the medial edge of the insole. The thickness of the insert at this ridge 40 is preferably about ⅛" to 3/16". The thickness of the insert at the lowest level is about 1/16" or so. The heel portion thus causes a varus wedge effect of about 3°–5° from the horizontal, while the forefoot portion causes a valgus wedge effect of about 3°–5° from the horizontal. On the sloped upper surfaces of the insole are preferably spaced, transverse, slightly elevated ribs 42 and 44 respectively.

In the forefoot region 12, polymeric layer 18 has greater thickness, e.g. about ⅛", on the lateral side 12 l than on the medial side 12 m, e.g., about 1/16" (FIG. 2) to complement the downwardly inwardly sloped portion at the medial side of ridge 40.

Diagonal ridge 40 assists in causing gradual roll of the foot inwardly from rear to front, the transverse length of the outwardly sloping surface on the outside of ridge 40 gradually decreasing and the transverse length of the inwardly sloping surface on the inside of ridge 40 gradually increasing.

Figure 8:
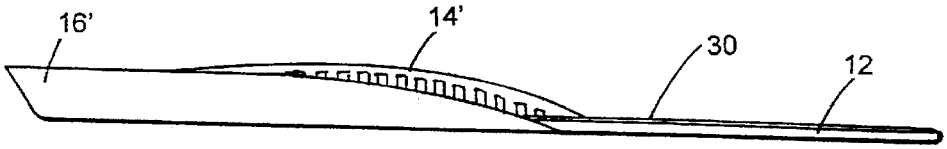
FIG. 8 is a side elevational view of the lateral side of the right shoe sole insert.
Figure 9:
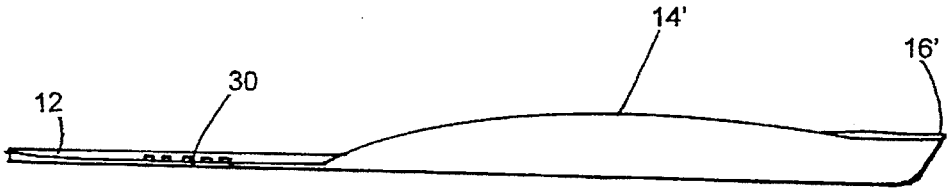
FIG. 9 is a side elevational view of the medial side of the right shoe sole insert.

The outer periphery of the heel portion preferably curves upwardly as at 16' (FIG. 8), extending forwardly on both the medial and lateral sides, with the medial side 14' in the midfoot area having a greater elevation. A linear concavity 48 extends in an are from the medial side of calcaneal pad 22 to the medial side of metatarsal pad 30, defining the lowest level at the medial side of the heel and midfoot portions. This linear concavity may be formed by depressing it under heat and pressure, and also because ribs 42 and 44 do not extend through it.

Formed into the bottom, i.e., underside, of polymeric layer 18 are passageways 50 for transfer of air between the heel portion and the forefoot portion when in use. That is, when pressure is placed on the heel pad, it depresses the heel pad and forces air forwardly from heel cavity 26 through passages 50 into metatarsal cavity 34 where it flows upwardly through orifices 36 to the forefoot. When pressure is put on the metatarsal pad, it depresses this pad into air cavity 34, causing air to flow rearwardly through passageways 50 to heel cavity 26 where it flows upwardly through orifices 28 to the heel portion.

One type of shoe utilizing the novel insert is shown at 60 in FIG. 17. This shoe has a sole subassembly 62 including a heel 64, and an upper subassembly 66 of conventional type. Insert 10 is shown placed inside the shoe upper, resting upon the inner sole of sole assembly 62.

Figure 12:
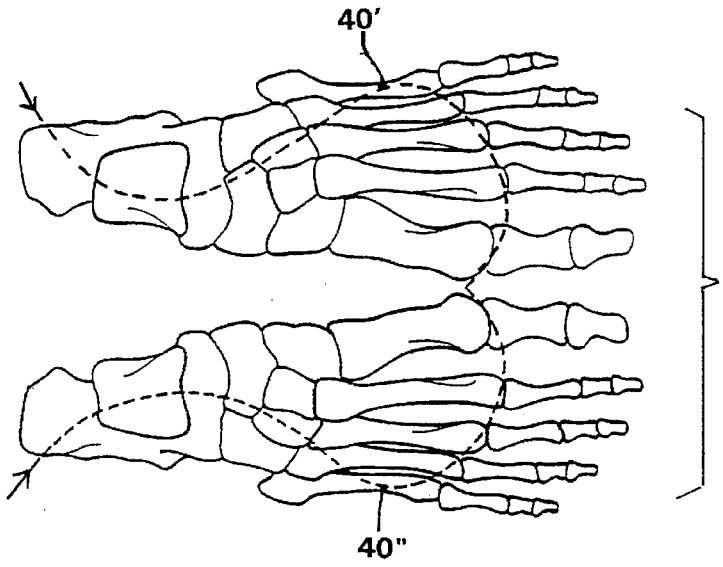
FIG. 12 is a plan view of the bones in a pair of human feet showing the path of travel of force on the feet and the support surface when bodily weight is shifted.

In the more casual shoe sole shown in FIGS. 1–9, the sole with its sloped characteristics defines a generally S-curve or reverse S-curve 40' depending upon whether it is the right foot or left foot, from the heel portion to the toe zone. This S-curve, shown in the form of a reverse S-curve in FIG. 12, curves across the rear of the heel, toward the medial side of the heel or rear foot portion, crossing over the longitudinal centerline of the shoe sole in the midfoot portion at 45 (FIG. 1), and then continuing along the lateral edge of the forefoot portion and across the metatarsal head portion of the toe zone of the shoe sole. The crossover point 45 at the midfoot portion of an average length shoe is at a distance from the rear of the shoe an amount equal to about the length of the shoe divided by 2.4. FIG. **11*b* shows the points of force applied by the calcaneum and by the metatarsal heads of a human foot, as well as the pattern of the force application when the body weight is rocked back and forth between the rear foot and forefoot portions. The central circle 60 in the heel shows where the calcaneum applies its force, while the smaller circles at 62, 64, 66, 68 and 70 show where the five metatarsal heads apply force in the forepart of the shoe. The specific heel bones and metatarsal bones, along with the metatarsal heads, are illustrated in FIG. 12. Applying the force points 60–70 of FIG. 11*b* to the skeletal foot structure in FIG. 12 gives the composite of FIG. 13 where these force points are shown applied by the calcaneum and the five metatarsal heads. The foot structure supporting this weight is depicted as the natural arch in FIG. 14**, with the five metatarsal heads being set forth therebelow in elevational form.

Figure 13:
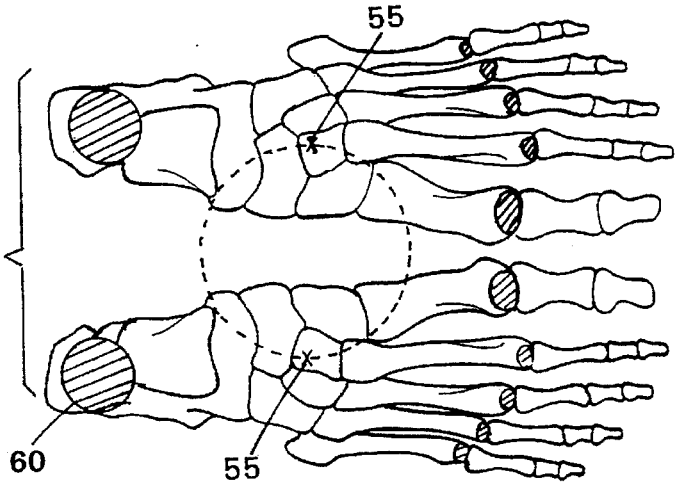
FIG. 13 is a plan view of the bones of a pair of human feet showing the main points of contact of the feet to the ground surface when standing.
Figure 14:
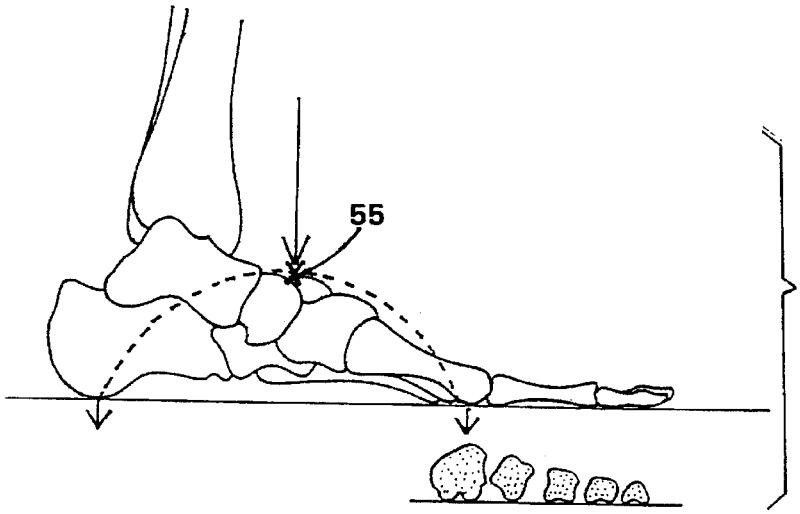
FIG. 14 is a side elevational view of the bones of a human foot, shown from the medial side, showing the arch relationship with the points of applied force between the foot and the support surface.

The crossover or pivot points 45 noted in the insert (FIG. 1) for both units corresponds to the center of the arch 55 (see the arrow) in the weight distribution (FIG. 14), which is the center of gravity of the body weight on the foot. This point is also shown in FIG. 13 and FIG. **11*b*. The pivot point 45** is the point that divides the heel zone where the insert biases the heel of the foot outwardly and the forefoot zone where the insert biases the forefoot of the foot inwardly. As noted previously, this pivot point is determined as the distance from the rear end of the insert equal to the insert length divided by 2.4.

The shoe to receive the novel insert is preferably made from a flat bottom last, i.e., is flat-bottom lasted, including a flat forefoot last, rather than the usual last forefoot, the bottom of which is convexly curved from side to side and front to back. The flat forefoot last L is depicted in solid lines in FIGS. 15 and 16 while the usual last is shown by the dash lines L' in FIGS. 15 and 16. The volume that is removed from the bottom of the last is added to the top of the last to assure adequate foot room in the resulting shoe. It has been found that a shoe made on the flat bottom last, combined with the novel insert, provides greater comfort than the combination novel insert in a shoe made on a convex bottom last.

In use, weight placed upon the heel of a person's foot will depress the resilient compressible calcaneal pad 22 and rock the rear of the foot downwardly-outwardly toward the lateral side of the shoe due to the downward-outward slope of the insert laterally of diagonal ridge 40. Subsequently, the forefoot portion of the person's foot will depress metatarsal pad 30 and be tilted downwardly-inwardly toward the medial side of the foot, insert and shoe. As a standing person rocks his or her weight backwardly and forwardly, the heel portion will cause depression of the heel pad and have a varus wedge effect of about 3°–5° while the forefoot portion will depress the metatarsal pad and have a valgus wedge effect of about 3°–5°. It has been determined that this arrangement considerably lessens fatigue of the foot and leg muscles during prolonged standing.

Applicant does not have a complete understanding of all foot characteristics of the complex foot structure which render the novel structure less fatiguing than conventional structures. The particular style of shoe using the unique insert may vary considerably to suit particular uses or classes of shoes without departing from the scope of the invention. It is intended, therefore, that the invention be limited only by the scope of the appended claims and the reasonably equivalent articles to those defined therein.

The embodiments of the invention in which an exclusive property or privilege is claimed are defined as follows:

1. A shoe sole insert for prolonged standing, comprising:

a flexible, elongated shoe sole insert having a heel portion with an upper surface, a midfoot portion with an upper surface, and a forefoot portion with an upper surface;

said insert comprising an underlayer of polymeric foam-type material bonded to an upper layer of cloth, thermoformed into a configuration defined as follows:

said heel portion upper surface being slanted downwardly at a small acute angle from the medial side of said heel portion to the lateral side of said heel portion, and having a central, resilient, compressible, calcaneal pad which is substantially unslanted;

said forefoot portion upper surface being slanted downwardly at a small acute angle from the lateral side of said forefoot portion to the medial side of said forefoot portion to be slanted opposite that of said heel portion upper surface, and having a central, resilient, compressible metatarsal head pad which is substantially unslanted.

2. The shoe sole insert in claim 1 wherein said calcaneal pad has an upper surface that protrudes upwardly above the surrounding area of said heel portion upper surface.

3. The shoe sole insert in claim 1 wherein said metatarsal head pad has an upper surface that protrudes upwardly above the surrounding area of said forefoot portion upper surface.

4. A shoe sole insert for prolonged standing, comprising:

a flexible, elongated shoe sole insert having a heel portion with an upper surface, a midfoot portion with an upper surface, and a forefoot portion with an upper surface;

said heel portion upper surface being slanted downwardly at a small acute angle from the medial side of said heel portion to the lateral side of said heel portion, and having a central, resilient, compressible, calcaneal pad which is substantially unslanted;

said forefoot portion upper surface being slanted downwardly at a small acute angle from the lateral side of said forefoot portion to the medial side of said forefoot portion to be slanted opposite that of said heel portion upper surface, and having a central, resilient, compressible metatarsal head pad which is substantially unslanted; and an elongated, upwardly protruding ridge extending diagonally from said medial side of said heel portion to said lateral side of said forefoot portion.

5. The shoe sole insert in claim 4 wherein said ridge is generally tangential to the medial side of said calcaneal pad and tangential to the lateral side of said metatarsal pad.

6. The shoe sole insert in claim 4 wherein said calcaneal pad has an upper surface that protrudes upwardly above the surrounding area of said heel portion upper surface, and wherein said calcaneal pad has an air cavity therebeneath and has orifices extending vertically from said air cavity to said calcaneal pad upper surface.

7. The shoe sole insert in claim 6 wherein said metatarsal head pad has an air cavity therebeneath and has orifices that extend vertically from said metatarsal pad air cavity to said metatarsal head pad upper surface, and wherein elongated channels extend between said calcaneal pad air cavity and said metatarsal pad air cavity.

8. The shoe sole insert in claim 4 wherein said metatarsal head pad has an upper surface that protrudes upwardly above the surrounding area of said forefoot portion upper surface, and wherein said metatarsal head pad has an air cavity therebeneath and has orifices that extend vertically from said air cavity to said metatarsal pad upper surface.

9. The shoe sole in claim 4 wherein said heel portion upper surface is slanted at an angle of about 3°–5° from the horizontal.

10. The shoe sole in claim 9 wherein said forefoot portion upper surface is slanted at an angle of about 3°–5° from the horizontal.

11. The shoe sole in claim 4 including a crossover point between said heel portion and said forefoot portion, said crossover point being at a distance from the rear end of said insert equal to the insert length divided by 2.4.

12. The shoe sole insert in claim 4 including a plurality of spaced, transverse, slightly elevated ribs.

13. The shoe sole insert in claim 4 wherein said calcaneal pad has a medial side and a lateral side, and said metatarsal pad has a medial side and a lateral side, and including a linear concavity extending in an arc from said medial side of said calcaneal pad to said medial side of said metatarsal pad.

14. The shoe sole insert in claim 13 including a plurality of spaced, transverse, slightly elevated ribs on opposite sides of said arc, and on opposite sides of said ridge.

15. A shoe and insert combination for prolonged standing, comprising:

an upper;

a shoe sole attached to said upper and having a heel portion, a midfoot portion, and a forefoot portion;

said upper and sole forming a foot receiving chamber;

an insert in said chamber, resting on said sole;

said insert comprising a flexible, elongated shoe sole insert having a heel portion with an upper surface, a midfoot portion with an upper surface, and a forefoot portion with an upper surface;

said heel portion upper surface being slanted downwardly at a small acute angle from the medial side of said heel portion to the lateral side of said heel portion, and having a central, resilient, compressible, calcaneal pad which is substantially unslanted;

said forefoot portion upper surface being slanted downwardly at a small acute angle from the lateral side of said forefoot portion to the medial side of said forefoot portion to be slanted opposite that of said heel portion upper surface, and having a central, resilient, compressible metatarsal head pad which is substantially unslanted; and an elongated, upwardly protruding ridge extending diagonally from said medial side of said heel portion to said lateral side of said forefoot portion.

16. The shoe and insert combination in claim 15 wherein said calcaneal pad protrudes upwardly above said heel portion upper surface and said metatarsal pad protrudes upwardly above said forefoot portion upper surface.

17. The shoe and insert combination in claim 15 wherein said insert heel portion upper surface and said insert midfoot upper surface slope away from the medial side of said ridge, said midfoot upper surface slopes away from the lateral side of said ridge, and said insert forefoot upper surface slopes downwardly from the lateral side to the medial side thereof.

18. The shoe and insert combination in claim 17 wherein said insert has an arcuately curved lower area extending from the medial side of said calcaneal pad to the medial side of said metatarsal pad.

19. The shoe and insert combination in claim 15 wherein said shoe is flat-bottom-lasted.

20. The shoe sole in claim 15 including a crossover point between said heel portion and said forefoot portion, said crossover point being at a distance from the rear end of said insert equal to the insert length divided by 2.4.

* * * * *

UNITED STATES PATENT AND TRADEMARK OFFICE

CERTIFICATE OF CORRECTION

PATENT NO. : 5,625,965
DATED : May 6, 1997
INVENTOR(S) : Malcolm G. Blissett et al.

It is certified that error appears in the above-identified patent and that said Letters Patent is hereby corrected as shown below:

Column 2, line 24;

"yams" should be –varus–.

Column 2, line 32;

"fight" should be –right–.

Column 2, line 35;

"fight" should be –right–.

Column 2, line 37;

"fight" should be –right–.

Column 2, line 44;

"fight" should be –right–.

Column 3, line 4;

"fight" should be –right–.

UNITED STATES PATENT AND TRADEMARK OFFICE

CERTIFICATE OF CORRECTION

PATENT NO. : 5,625,965
DATED : May 6, 1997
INVENTOR(S) : Malcolm G. Blissett et al.

It is certified that error appears in the above-identified patent and that said Letters Patent is hereby corrected as shown below:

Column 3, line 4;

"fight" should be –right–.

Signed and Sealed this

Sixteenth Day of December, 1997

Bruce Lehman

*Attest:*

BRUCE LEHMAN

*Attesting Officer*

*Commissioner of Patents and Trademarks*